United States Patent [19]

Hooker

[11] 4,257,512

[45] Mar. 24, 1981

[54] COIN ACCEPTOR APPARATUS

[75] Inventor: Donald E. Hooker, Wilmette, Ill.

[73] Assignee: Bally Manufacturing Corporation, Chicago, Ill.

[21] Appl. No.: 11,123

[22] Filed: Feb. 12, 1979

[51] Int. Cl.[3] ..... G07F 3/00

[52] U.S. Cl. ..... 194/100 A

[58] Field of Search ..... 194/100 R, 100 A, 97 R, 194/97 A; 73/163

[56] References Cited

U.S. PATENT DOCUMENTS

| | | | |
|---|---|---|---|
| 2,540,063 | 1/1951 | Victoreen | 194/100 A |
| 3,401,780 | 9/1968 | Jullien-Davin | 194/100 R |
| 4,106,610 | 8/1978 | Heiman | 194/100 A X |

FOREIGN PATENT DOCUMENTS

| | | | |
|---|---|---|---|
| 2001962 | 2/1968 | France | 194/100 A |

*Primary Examiner*—Joseph J. Rolla

*Attorney, Agent, or Firm*—Fitch, Even, Tabin, Flannery & Welsh

[57] ABSTRACT

A coin acceptor apparatus has circuitry for energizing a first coil so as to induce a signal in a second coil while a coin to be tested is passed between the coils. Circuitry is further provided for cancelling the signal induced in the second coil when a genuine coin passes between the coils, so that the resultant signal is reduced below a predetermined level. Also, the apparatus accepts the coin when the resultant signal is below the predetermined level, and rejects it when the signal is above the predetermined level.

20 Claims, 5 Drawing Figures

COIN ACCEPTOR APPARATUS

The present invention relates to coin acceptor and rejector apparatus.

In vending machines, gaming and slot machines and other coin operated devices, it is, of course, very important to be able to discriminate between genuine coins of the proper denomination on the one hand and slugs, counterfeit coins, and foreign coins on the other. These counterfeit coins and slugs are being fashioned with increasing sophistication and a coin acceptor or rejector must be able to distinguish them from genuine coins. Furthermore, a coin from one country may have a striking similarity of size and composition with a coin from another country, but have a marked difference in value.

Various systems and designs for coin acceptors have been proposed. These systems may include a primary coil which is energized in some manner and a secondary coil positioned adjacent to the primary coil. When the coin to be tested is passed between the primary coil and a secondary coil, a signal is induced in the secondary coil which is then measured or compared with reference signals in some manner. Such designs often are complicated, unreliable or are not sufficiently sensitive to reject close copies of the genuine coin.

Other designs include those such as suggested in Hinterstocker, U.S. Pat. No. 3,599,771, wherein a standard coin is placed between a primary coil and a first secondary coil and a test coin is then passed between the primary and a second secondary coil. This design utilizing a standard coin as a reference has a number of drawbacks, especially in gaming machines, and is vulnerable to repairmen and others having access to the inside of the machine for the reason that the repairman can easily substitute a slug or some lesser value coin for the standard coin and thereby cheat the machine.

It is an object of the present invention to provide an improved and reliable coin acceptor apparatus which does not experience the above mentioned limitations, and which is particularly advantageous in that it only requires a relatively uncomplicated electrical circuit.

Other objects and advantages are more particularly set forth in the following detailed description, and in the accompanying drawings, of which:

Figure 1:
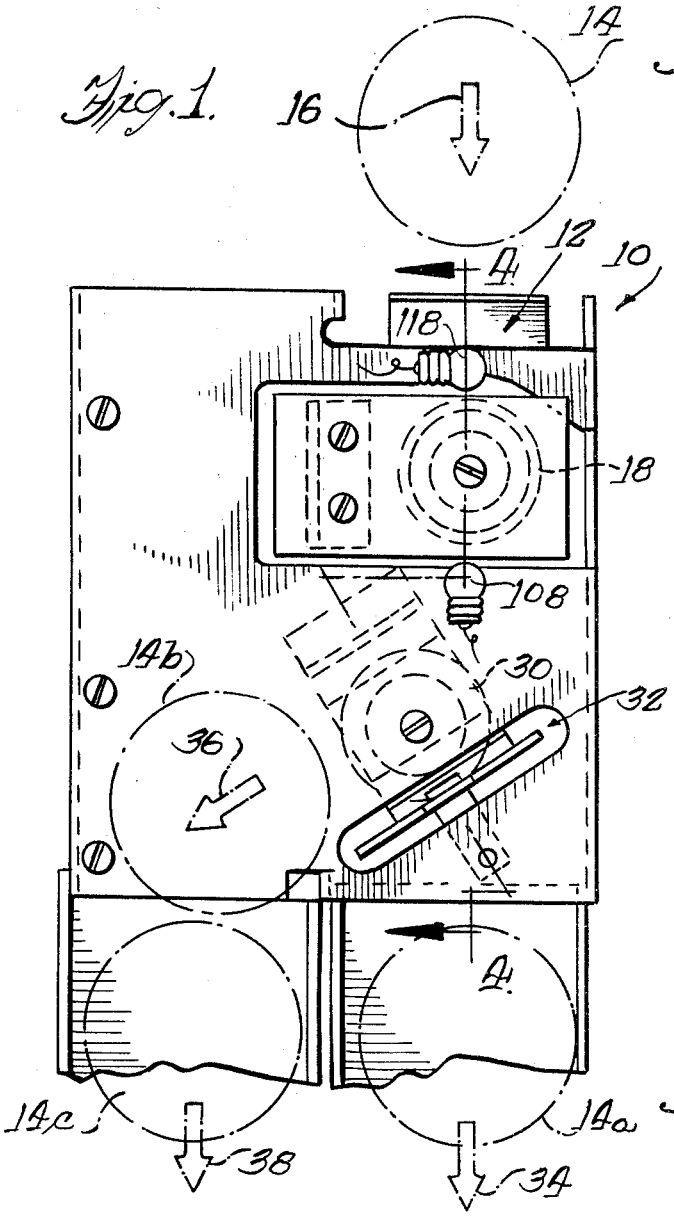
FIG. 1 is a front view of a coin acceptor mechanism constructed in accordance with an embodiment of the present invention.
Figure 2:
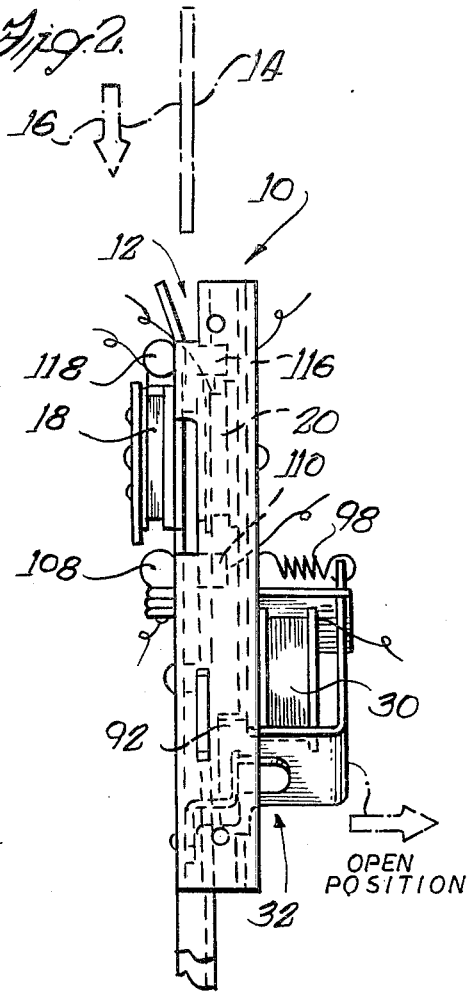
FIG. 2 is a side view of the coin acceptor mechanism of FIG. 1 and illustrates the coin acceptor mechanism in an open position.

The coin acceptor apparatus comprises a coin acceptor mechanism indicated generally at 10 in FIGS. 1–4. The mechanism 10 has a coin chute which defines paths which a coin can take as the coin passes through the mechanism. At the beginning of the coin chute is a coin opening 12 (as best seen in FIG. 2) through which a coin 14 can enter the coin mechanism 10 along the path indicated by the arrow 16. A first coil 18 is provided on one side of the path 16 with a second coil 20 provided on the other side of the path 16 so that the coin 14 may pass between the coils 18 and 20 with the flat surfaces of the coin 14 substantially parallel to the coil faces. A signal generating means indicated generally at 22 in FIG. 5 is provided for energizing the first coil.

The coil 18 and the coil 20 are coupled so that when the coil 18 is energized by the signal generating means 22, a signal is induced in the second coil 20. As the coin 14 passes between the coils 18 and 20, the signal induced in the second coil 20 is modified in a manner dependent upon particular electrical characteristics of the coin. Phase shifting and attenuation means conductively connected to the signal generating means 22, and indicated generally at 24 in FIG. 5, are provided for cancelling the signal induced in the second coil 20 to a value below a predetermined level when a proper and genuine coin passes between the coils. Detector means, indicated generally at 26, are provided for detecting the level of the signal induced in the second coil, particularly its level relative to the predetermined level, and acceptor control means, indicated generally at 28, are provided for accepting the coin when the signal induced in the second coil 20 is detected to be below the predetermined level.

In the illustrated coin acceptor apparatus, the acceptor control means 28 comprises an electromagnet 30 and a deflector bar 32. When the signal induced in the second coil 20 is not cancelled below the predetermined level, the electromagnet 30 is not energized and the deflector bar 32 remains out of the path of the dropped coin 14. Thus, the coin will continue undeflected along the path indicated by the arrow 34 as represented by the phantom coin 14*a* (FIG. 1). However, when a genuine coin of the correct denomination is dropped into the opening 12, the resultant signal in the second coil 20 is reduced to a level below the predetermined level and the electromagnet 30 is then energized, which attracts the deflector bar 32 causing the bar 32 to protrude into the path of the dropping coin 14. This causes the coin to be deflected into the path indicated by the arrow 36 and represented by the phantom coin 14*b* (FIG. 1). The coin then drops into the path indicated by the arrow 38, represented by the phantom coin 14*c*. The path 38 leads to a coin switch, which indicates to the coin operated machine that a coin has been accepted, and then leads to the coin box. The path 34 leads to the coin return opening.

Figure 5:
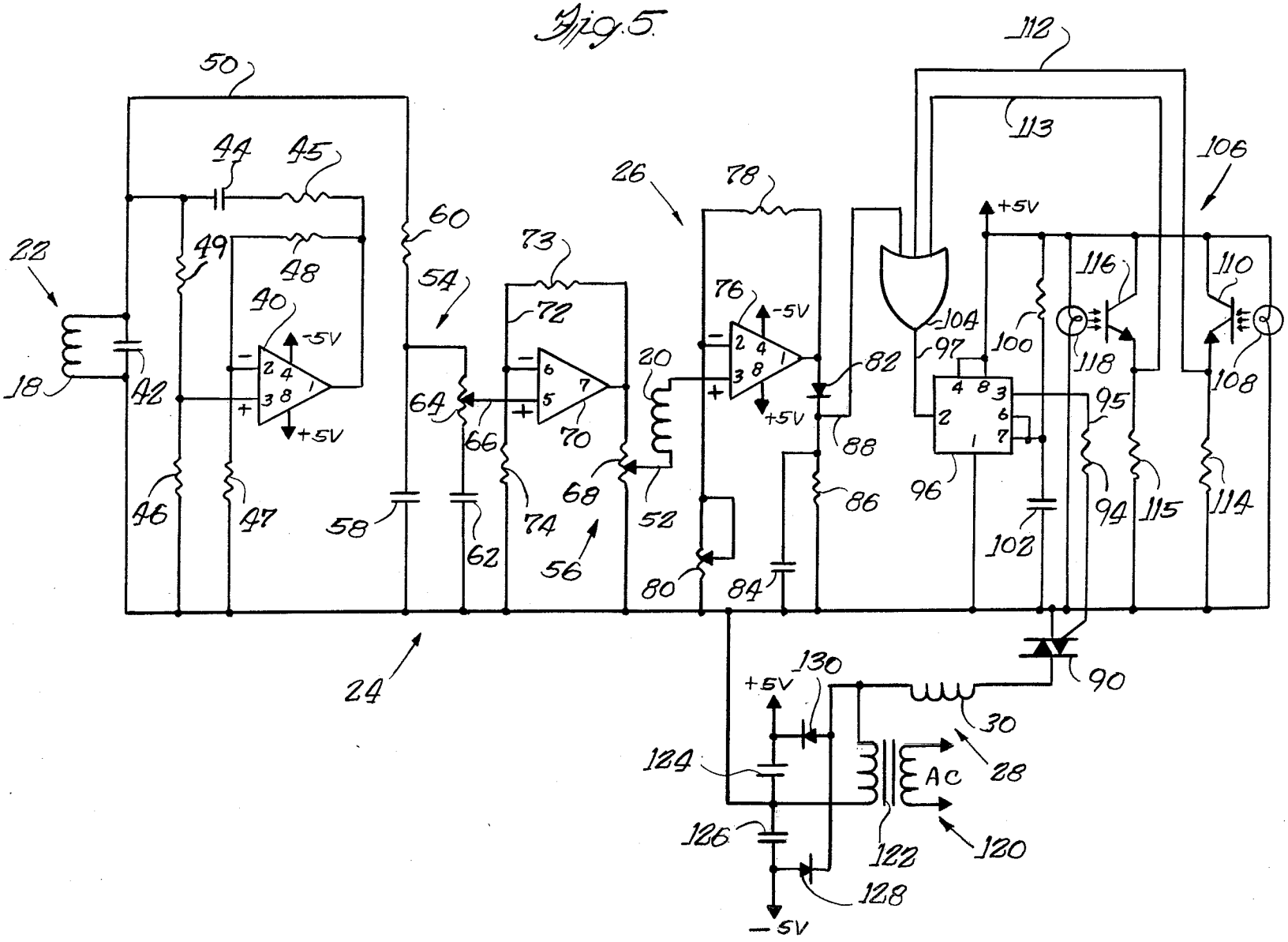
FIG. 5 is a schematic representation of a coin acceptor circuit constructed in accordance with an embodiment of the present invention.

Turning now to a more detailed description of the coin acceptor circuit shown in FIG. 5, the signal generating means 22 comprises an oscillator circuit having an operational amplifier 40. The output of the operational amplifier 40 is fed, through a resistor 45 and a capacitor 44, to the coil 18 and parallel capacitor 42. Any voltage appearing across coil 18 is reduced by the series circuit of resistors 49 and 46 and fed to the noninverting input terminal of operational amplifier 40. This positive feedback circuitry causes an oscillating voltage to appear across coil 18 and capacitor 42 at the resonant frequency of the coil and capacitor circuit. The series circuit comprising resistors 48 and 47 present a reduced output voltage to the inverting input terminal of the operational amplifier. This reduces the effective gain and causes a good sine wave current to flow in coil 18.

The second coil 20 is electromagnetically coupled to the first coil 18 by positioning the second coil 20 in close physical proximity to the first coil 18 and in coaxial alignment therewith on opposite sides of the coin path 16. Since the second coil is coupled to the first coil, the oscillating signal in the first coil 18 causes an oscillating signal to be induced in the second coil 20. The signal induced in the second coil 20, however, is modified by the passing of a coin between the coils 18 and 20. The degree of modification depends upon the particular characteristics of the coin being passed therebetween. These characteristics include the size, shape and alloy content of the coin, which affect its resistivity and/or other electrical parameters.

The coin, as it passes between the coils 18 and 20, acts as a shorted turn and causes the phase of the signal induced in the second coil 20 to be shifted and the amplitude of the signal to be changed. Since the characteristics of the signal induced in the second coil 20 depend upon the characteristics of the particular type of coin passing between the coils, these signal characteristics may be utilized to distinguish among the coins passing between the coils to identify a proper genuine coin.

The phase shifting and attenuating circuit 24 supplies the signal from the top of the tank circuit associated with the first coil 18 via line 50 and modifies the signal to provide a signal at a line 52 that is approximately equal in amplitude but opposite in phase to a signal induced in the second coil 20 when a genuine coin of the proper type given passes between the coils 18 and 20. Thus, if the proper given type is, for example, a U.S. silver dollar, the signal induced in the second coil 20 and the signal provided by the circuit 24 will momentarily cancel when a U.S. silver dollar passes between the two coils 18 and 20.

The circuit 24 comprises a phase shifting circuit indicated generally at 54 and an attenuating circuit indicated generally at 56. The phase shifting circuit 54 comprises a first R-C combination of a capacitor 58 and a resistor 60 connected by the line 50 from the oscillator circuit, and a second R-C combination comprising capacitor 62 and a variable resistor 64 that is connected to the junction of the first R-C combination. The principal phase shift is determined by the first R-C combination, and the precise degree of shifting caused by the phase shifting circuit 54 is adjustable through the second R-C combination so that the phase of the signal on line 66 connected to the potentiometer 64 may be set to the proper value.

The phase shifting circuit 54 is preferably adjusted so that the phase of the output signal that is applied to the second coil 20 is 180° out of phase with a signal that would be induced in the second coil 20 when a genuine coin of the proper given type passes between the coils. This results in a mutual cancellation of the signals, provided the signals also have the same amplitude, as will be hereinafter described.

The phase adjusted signal on line 66 is fed to the noninverting input of an operational amplifier 70. The voltage dividing circuit of resistors 73 and 74, connected to the inverting input, controls the amount of amplification. The potentiometer 68, connected to the output of the amplifier, gives the amplitude adjustment necessary to furnish a signal on line 52 equal and opposite to the signal picked up by coil 20.

The detector means 26 comprises a means for adjusting the device's sensitivity to an improper coin. With the proper adjustments for phase and amplitude, coil 20 will balance out the voltage on line 52 to a value that is close to zero. The amount of its departure from zero because of a slug determines the criteria for slug rejection. Because this voltage is so low, it must be amplified before it is rectified and presented to a threshold. A resistor 78 and variable resistor 80 constitute a voltage dividing circuit for adjusting the amount of negative feedback given to the operational amplifier and thus controlling the gain. The output of amplifier 76 is rectified by a diode 82 and fed to a resistor 86 and filtered by a capacitor 84. The rectified output of the amplifier appears on line 88.

Figure 4:
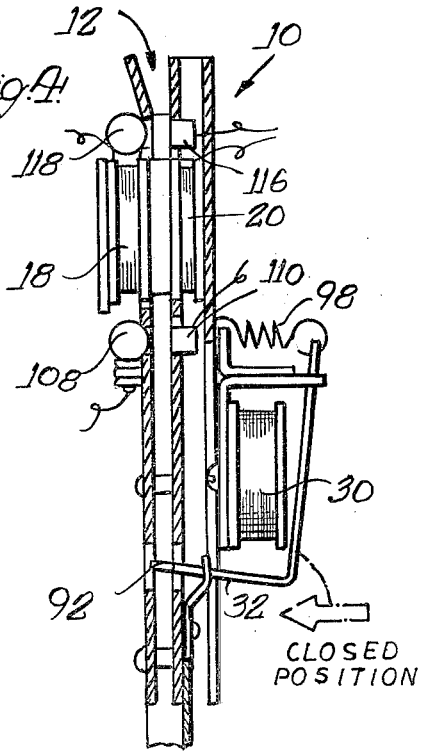
FIG. 4 is a cross-sectional view taken generally along line 4—4 of FIG. 1 and illustrates the coin acceptor mechanism in a closed position.

When the output signal on line 88 goes low, a triac 90 can be rendered conductive to energize the coil of the electromagnet 30. The energization of the electromagnet 30 attracts the deflector bar 32 causing the tip 92 of the deflector bar to extend into the path of the downward traveling coin as shown in FIG. 4. In this closed position, the coin is deflected into path 36 of the coin chute and passes down into the coin box as shown in FIG. 1.

The gate of the triac 90 is connected to a current-limiting resistor 94 which is also connected by line 95 to the output of a monostable timing integrated circuit 96. When the input line 97 of the timing circuit goes low, the output line 95 goes high for a desired predetermined period causing the triac 90 to be turned on for the predetermined time period. This couples the electromagnet 30 to a power source 120 and the electromagnet 30 is energized and the deflector bar 32 is pulled into the closed position for the predetermined time period. At the end of the time period, the output line 95 of the integrated circuit 96 goes low permitting the triac 90 to be turned off by the AC supply and the electromagnet 30 is accordingly de-energized.

Figure 3:
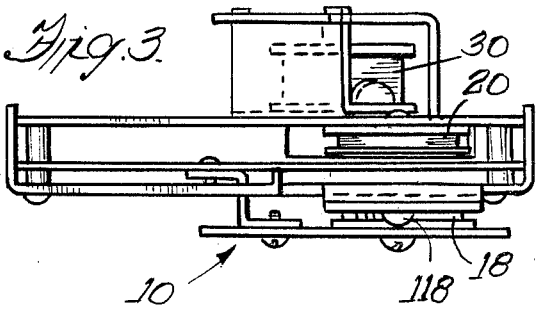
FIG. 3 is a top view of the coin acceptor mechanism of FIG. 1.

As is particularly shown in FIGS. 3 and 4, a spring 98 is coupled to the deflector bar 32 so that upon de-energization of the electromagnet 30, the spring 98 will pull the deflector bar 32 back into the open position shown in FIG. 2. Thus, the deflector bar 32 is in the closed position essentially only during the predetermined time period which is preferably just long enough to deflect the coin which initiated the time period, and is withdrawn before a succeeding coin is present so that it will not be deflected into the accepted path. The time period is determined by a series connected resistor 100 and capacitor 102 which are coupled to the timing integrated circuit 96 as shown in FIG. 5.

The input line 97 of the timing circuit 96 is supplied by the output of a gate 104 having one input provided by the output line 88 of the detector circuit 26 and the other inputs supplied by a second detector circuit 106 comprising photo transistors 110 and 116 which will be more fully described later. Upon a coincidence of low states on all of the inputs of the gate 104, the output of the gate 104 will be low which triggers the timing circuit 96 causing the triac 90 to be conductive for the predetermined time period.

As shown in FIGS. 1–3, the coin acceptor mechanism 10 has lamps 108 and 118, respectively, positioned below and above the first coil 18 and the photo transistors 116 and 110 are respectively positioned below and above the second coil 20. The lamp 108 and photo transistor 110 respectively, are positioned relative to one another, as are the lamp 118 and photo transistor 116, so that as the coin leaves the center position between the coils 18 and 20, the light from the lamp 108 to the photo transistor 110 is cut off and the light from the lamp 118 to the photo transistor 116 is cut off. The photo transistor circuit 106 has an emitter-coupled resistor 114 and photo transistor 116 has an emitter-coupled resistor 115. At the time the light from each lamp is cut off, the output lines 112 and 113 (FIG. 5) from the respective photo transistors 110 and 116 go low. If the coin passing by the coils 18 and 20 is of proper size and is genuine, the output signal on line 88 of the detector circuit 26 will also be low, resulting in the triggering of the timing circuit 96 and the coin will be accepted. In this manner, the acceptor circuit can examine the coin at a relatively precise position as it travels down the chute. Thus, the coin acceptor circuit will effectively measure at the coin only in a particular position with respect to the coils 18 and 20. If light reaches one or both of the photo transistors 110 and 116, the coin is "out of position" and the timing circuit 96 cannot be triggered regardless of the output of the detector circuit.

This causes coins which are smaller than the proper size to be automatically rejected by inaction of the acceptor, as well as minimizing accidental acceptance of a non-genuine coin which may resemble the genuine coin in electrical response when in a non-centered position relative to the two coils 18 and 20. Coins larger than the proper size may also be rejected by mechanical means (such as, for example, simply the size of the coin slot, or perhaps some more complicated device) in addition to the electrical coin acceptor presently described. It should also be understood that the spacing between the photo transistors 110 and 116 should be compatible with the size of the desired coin, so that both photo transistors will be non-conducting when the proper sized coin is centered relative to the coils.

The photo transistor circuit 106 is optional in that line 88 may be connected directly to the input line 97 of the timing circuit 96. In such event, the acceptor bar 32 would be actuated when the signals in the second coil 20 cancel to an acceptable level.

A power supply circuit 120 comprises a transformer 122 coupled to an AC power source as well as capacitors 124 and 126, and diodes 128 and 130. The voltage source 120 provides the supply voltages, +5 volts and −5 volts, as well as AC power for the electromagnet 30 when the triac 90 is conductive.

Briefly summarizing the operation of the coin acceptor apparatus, the oscillator circuit 22 shown in FIG. 5 energizes the first coil 18 so that a signal is induced in the second coil 20 that is coupled to the first coil 18. This signal is modified as a coin passes between the first coil and the second coil 20. The circuit shown in FIG. 5 can be adjusted so that as a coin of a particular type passes between the coils, the signal induced in the second coil 20 is cancelled to a level below a predetermined level. This is accomplished by driving the second coil 20 with a signal having an equal amplitude but opposite phase of the signal that will be induced in the second coil 20 when the coin of the particular type passes through. The desired amount of phase shift is obtained by adjusting variable resistor 64 and the desired degree of amplification is obtained by adjusting variable resistor 68. These variable resistors are adjusted so that the apparatus accepts the particular type of coin desired.

As the coin traveling down the chute passes in front of the lamps 108 and 118, the light received by the photo transistors 110 and 116 is cut off, resulting in a low state on input lines 112 and 113 of the gate 104. When the induced signal in the second coil 20 is cancelled below the reference level, the detector circuit 26 causes the other input of the gate 104 to go low. Upon a coincidence of low states on all three inputs, the gate 104 triggers the timing circuit 96 which causes the deflector bar 32 to extend into the path of the descending coin causing the coin to be deflected into the coin box. In this manner, the coin is accepted. If the coin is not of the particular type expected, the signal induced in the second coil 20 will not be cancelled and the electromagnet 30 will not be energized.

As can be seen from the foregoing description, the circuitry of FIG. 5 is adaptable to modification so that the coin acceptor will accept the type of coin desired. Thus, by adjusting the variable resistor 64, the amount of phase shift can be set. Similarly, by adjusting the variable resistor 68, the amount of amplification is set so that the desired type of coin will be accepted and all others rejected. However, these are not the type of adjustments that can be quickly made by an unauthorized person in order to cheat the machine. Any tampering with the settings of the variable resistors 64 and 68 are more likely than not to cause the circuit to reject all coins. Further protection against tampering may be provided by replacing the variable resistors 64 and 68 with fixed resistances once the particular type of coin to be accepted has been selected and the corresponding resistances for the fixed resistors replacing the variable resistances 64 and 68 have been determined.

Furthermore, the illustrated apparatus is not subject to fluctuation in line voltages or frequencies. Since the oscillator circuit 22 energizes not only the first coil 18 but also provides the input signal to the phase shifting circuit 54 and attenuation circuit 56, any drift in line voltage or frequency will affect the signal induced in the second coil 20 in the same manner as the signal provided by the phase shifting ahd attenuating circuits 54 and 56. Hence, if the proper type of coin is passed between the coils 18 and 20, the signal induced in the second coil 20 will still be cancelled out and the coin accepted.

It will, of course, be understood that modifications of the present invention, in its various aspects, will be apparent to those skilled in the art, some being apparent only after study, and others being merely matters of routine electronic design. As such, the scope of the invention should not be limited by the particular embodiment and specific construction herein described, but should be defined only by the appended claims, and equivalents thereof.

Various features of the invention are set forth in the following claims.

What is claimed is:

1. An apparatus for accepting coins of a particular type, comprising:

a first coil and a second coil electromagnetically coupled to the first coil, said coils being arranged to allow a coin to pass therebetween;

signaling means comprising an oscillator operatively connected to the first coil for energizing the same to induce a signal in the second coil as the coin passes between the coils;

means conductively connected to the signaling means for providing a signal to the second coil having a phase shifted substantially 180° out of phase relative to the signal that is induced in the second coil for cancelling the signal induced in the second coil to a level below a predetermined level, said signal providing means further including means for attenuating the phase shifted signal to the second coil to provide a signal of substantially equal amplitude to a signal that is induced in the second coil when a coin of the particular type passes between the coils, so that the signal of the signal providing means cancels the signal induced in the second coil to a level below the predetermined level in response to a coin of the particular type passing between the coils;

means for detecting the level of the signal induced in the second coil; and means responsive to the detecting means for accepting the coin when the signal induced in the second coil is below the predetermined level.

2. The apparatus of claim 1 wherein the shifting means is variable so that the apparatus can be adjusted to accept the particular type of coin.

3. The apparatus of claim 1 wherein the attenuating means is variable so that the apparatus can be adjusted to accept the particular type of coin.

4. The apparatus of claim 3 wherein the attenuating means comprises a variable resistor.

5. The apparatus of claim 1 wherein the phase shifting means comprises a resistor in series with a capacitor.

6. The apparatus of claim 5 wherein the resistor in series with the capacitor is a variable resistor.

7. The apparatus of claim 1 wherein the detecting means comprises a comparator.

8. The apparatus of claim 7 wherein the detecting means further comprises a variable resistor so that the predetermined level may be varied so as to vary the sensitivity of the apparatus.

9. The apparatus of claim 7 wherein the comparator comprises an operational amplifier.

10. The apparatus of claim 1 wherein the accepting means comprises an electromagnet actuatable in response to the detecting means, and means operably connected to the electromagnet for deflecting the path of the coin when the electromagnet is actuated whereby the coin is accepted.

11. The apparatus of claim 10 wherein the accepting means further comprises a switch responsive to the detecting means and in series with the electromagnet whereby the electromagnet is actuated in response to the detecting means.

12. The apparatus of claim 11 wherein the accepting means further comprises a timing circuit operably connected to the switch for timing an interval in response to the detecting means and for closing said switch during the interval whereby the electromagnet may be actuated during the interval.

13. The apparatus of claim 1 further comprising a second detecting means for detecting the position of the coin as it passes between the coils.

14. The apparatus of claim 13 wherein the second detecting means also has means for enabling the accepting means to perform its associated function when the coin passes a predetermined position.

15. The apparatus of claim 14 wherein the second detecting means comprises a light sensitive switch and a light source which are arranged so that the light transmitted from the light source to the light sensitive switch is cut off as the coin passes the predetermined position and also comprises means for transmitting a signal when the light is cut off.

16. The apparatus of claim 15 wherein the enabling means comprises a logic gate having an output operatively connected to the accepting means and a first input operatively connected to the first detecting means and a second input operatively connected to the second detecting means and being responsive to pass a signal to the accepting means from the first detecting means upon receiving a signal from the second detecting means so that the accepting means is responsive to the first detecting means when the coin passes the predetermined position.

17. The apparatus of claim 15 wherein the light sensitive switch comprises a photo transistor.

18. The apparatus of claim 15 wherein the second detecting means further comprises a second light source and a second light sensitive switch arranged on a side opposite the coils from the first light source and light sensitive switch so that the light to both light sensitive switches is cut off as the coin passes the predetermined position.

19. An apparatus for accepting coins of a particular type, comprising:

a first coil and a second coil electromagnetically coupled to the first coil, said coils being arranged to allow a coin to pass therebetween;

an oscillator circuit having an output operatively connected to the first coil for energizing the first coil to induce an oscillating signal in the second coil as the coin passes between the coils;

a resistor-capacitor circuit having an input operatively connected to the oscillator circuit output and having an output for shifting the phase of the signal at the output of the oscillator to provide a signal having a phase substantially 180° out of phase with the signal induced in the second coil when the coin of the particular type passes between the coils;

an attenuation circuit having an input operatively connected to the output of the resistor-capacitor circuit and an output operatively connected to the second coil, and comprising an amplifier and two divider resistors to provide a signal having substantially the same amplitude but substantially 180° out of phase with the signal induced in the second coil when the coin of the particular type passes between the coils whereby the signal induced in the second coil is substantially cancelled when the coin passes between the coils is of the particular type;

a comparator operatively connected to the second coil for detecting the substantial cancellation of the signal induced in the second coil;

a plurality of light source-photo transistor pairs arranged to detect the coin passing a predetermined position in relation to the coils;

a logic gate having input operatively connected to the comparator and the photo transistors for providing an output signal upon the coincidence of the substantial cancellation of the signal induced in the second coil and the coin passing the predetermined position;

a timing circuit generating a monostable output signal for a predetermined period upon receiving a signal from the logic gate;

an electromagnet;

a bar operatively connected to the electromagnet to deflect the coin out of its path when the electromagnet is energized; and triac switch means operatively connected to the electromagnet and having a gate operatively connected to the output of the timing circuit for energizing the electromagnet for the predetermined period.

20. An apparatus for accepting coins of a particular type, comprising:

a first coil and a second coil electromagnetically coupled to the first coil, said coils being arranged to allow a coin to pass therebetween;

signaling means for energizing the first coil to induce a signal in the second coil as the coin passes between the coils;

means conductively connected to the signaling means for cancelling a signal induced in the second coil to a level below a predetermined level in response to a coin of the particular type passing between the coils;

first detecting means for detecting the level of the signal induced in the second coil;

means responsive to said first and a second detecting means for accepting the coin when the signal induced in the second coil is below the predetermined level;

second detecting means for detecting the position of the coin as it passes between the coils, said second detecting means also including means for enabling the accepting means to perform its associated function when the coin passes a predetermined position and comprising a light sensitive switch and a light source that are arranged so that light transmitted from the light source to the light sensitive switch is cut off as the coin passes the predetermined position and for transmitting an enabling signal when the light is cut off;

said enabling means comprising a logic gate having an output operatively connected to the accepting means and a first input operatively connected to the first detecting means and a second input operatively connected to the second detecting means and being responsive to pass a signal to the accepting means from the first detecting means upon receiving the enabling signal from the second detecting means so that the accepting means is responsive to the first detecting means when the coin passes the predetermined position.

* * * * *